US006186913B1

(12) United States Patent
Thomas

(10) Patent No.: US 6,186,913 B1
(45) Date of Patent: Feb. 13, 2001

(54) HUNTING ARROW AND METHOD

(76) Inventor: Ronald L. Thomas, P.O. Box 1210, Frankston, TX (US) 75763

( * ) Notice: Under 35 U.S.C. 154(b), the term of this patent shall be extended for 0 days.

(21) Appl. No.: 09/573,456

(22) Filed: May 17, 2000

(51) Int. Cl.[7] ..... F42B 6/04
(52) U.S. Cl. ..... 473/581
(58) Field of Search ..... 473/578, 581, 473/FOR 216, FOR 218

(56) References Cited

U.S. PATENT DOCUMENTS

| | | | | |
|---|---|---|---|---|
| 2,554,012 | | 5/1951 | Cohen | 473/581 |
| 3,393,912 | | 7/1968 | De Lonais | 473/581 |
| 3,617,060 | | 11/1971 | Iezzi | 473/581 |
| 3,993,311 | | 11/1976 | Johnson | 473/585 |
| 4,252,325 | | 2/1981 | Weems et al. | 473/581 |
| 4,277,069 | | 7/1981 | Rouse | 473/581 |
| 4,463,953 | | 8/1984 | Jordan | 473/581 |
| 4,541,636 | | 9/1985 | Humphrey | 473/578 |
| 4,726,594 | | 2/1988 | Benke | 473/581 |
| 4,729,320 | * | 3/1988 | Whitten | 473/584 X |
| 4,762,328 | | 8/1988 | Beyl | 473/585 |
| 4,944,520 | | 7/1990 | Fingerson et al. | 473/582 |
| 5,183,259 | | 2/1993 | Lyon | 473/581 |
| 5,314,196 | | 5/1994 | Ruelle | 473/578 |
| 5,762,574 | | 6/1998 | Mashburn | 473/578 |

* cited by examiner

*Primary Examiner*—John A. Ricci
(74) *Attorney, Agent, or Firm*—Dennis T. Griggs

(57) ABSTRACT

A hollow shaft hunting arrow carries a small volume of liquified carbon dioxide which is released by flash expansion upon penetration into the thorax of a game animal. The thorax is pressurized with carbon dioxide gas at sub-zero temperature to cause collapse of the lungs and fibrillation of the heart, so that the animal can be harvested on the spot, thus avoiding escape and uncertain recovery. The liquified carbon dioxide is carried in an internal reservoir and is released by flash expansion upon opening actuation of a valve closure member. The arrowhead includes a freely movable center core which is attached to an actuator shaft that is engagable with a release valve. The release valve is actuated by either piercing a metallic membrane, fracturing a glass or ceramic lens or unseating the ball closure of a ball valve assembly. A small amount of fluorescent dye is introduced into the liquified carbon dioxide which provides a marker in the blood trail left by a wounded animal which will fluoresce or glow when exposed to ultraviolet light.

21 Claims, 4 Drawing Sheets

HUNTING ARROW AND METHOD

FIELD OF THE INVENTION

This invention is related generally to hunting arrows for harvesting large game animals such as elk and deer, and in particular to a hollow shaft hunting arrow which carries liquid carbon dioxide that is released by flash expansion to produce tension pneumothorax upon penetration.

BACKGROUND OF THE INVENTION

The traditional bow hunting method for harvesting large game animals is to kill by exsanguination. The design of conventional hunting arrows has been optimized to produce the most effective method for draining the animal's blood from its circulatory system, thus interrupting the animal's ability to provide adequate tissue profusion. Without an adequate blood supply in the circulatory system, the exchange of oxygen and carbon dioxide at the tissue level cannot continue. The oxygen level then drops and the carbon dioxide level rises until the balance between the two are incompatible with life and the animal expires, achieving the primary goal of harvesting the animal.

However, because the kill is not instantaneous, the game animal has the ability to travel quickly and far from the position it is standing when first struck by the arrow. During the course of its wounded flight, especially in larger animals such as deer or elk, the animal quickly disappears from sight, and the hunter is then burdened with the task of tracking the wounded animal, aided primarily by the blood trail. The blood trail is difficult to follow and so the animal may not be found. The mortally wounded animal may endure unnecessary suffering and may escape to an inaccessible location.

Consequently, improvements in modern hunting arrows for large game animals have been directed to achieving a rapid kill. Some improvements have been directed to maximizing the cutting effect of the arrow head to improve the chance of severing a major blood vessel, thus promoting a quick kill, for example as shown in U.S. Pat. No. 4,762,328. In that patent, a game arrowhead consists of a fixed broad head point with splines that deform and expand upon impact, thus creating greater tissue displacement and trauma effect upon penetration.

U.S. Pat. No. 4,277,067 discloses a hollow arrow shaft which has drainage apertures to promote exsanguination.

U.S. Pat. Nos. 4,252,352; 3,993,311 and 5,314,196 disclose arrows that have a hollow shaft which contain components for enhancing bleeding in a wounded animal and for facilitating tracking the wounded animal.

U.S. Pat. No. 4,277,069 discloses an arrow for blood tracking which includes a tubular shank which is perforated with drainage holes along its length.

Another hunting arrow improvement that represents a departure from the conventional exsanguination technique is disclosed in U.S. Pat. No. 3,617,060. The hollow shaft hunting arrow includes a longitudinal passage which communicates with the atmosphere. When the arrowhead pierces the thoracic wall of the animal, the thoracic cavity is connected directly in communication with the atmosphere by the longitudinal passage. When this occurs, the internal pressure of the thoracic cavity rises from below atmospheric to atmospheric, thus resulting in collapse of the animal's lungs.

Yet another hunting arrow improvement includes apparatus for releasing pressurized air upon penetration, where the pressurized air enhances the cutting effectiveness of the arrowhead, for example as disclosed in U.S. Pat. No. 5,762,574. The hunting arrow has a hollow shaft which is pressurized with compressed air. Upon penetration into the animal, the compressed air is released through vents at a pressure of about 150 psi as a release valve opens. The pressurized air exacerbates the localized wound inflicted by the arrow head, thus accelerating trauma to soft tissue.

Further improvements have included an arrow that is fitted with a cylindrical cartridge containing a chemical drug material that will paralyze, incapacitate or kill a game animal by injecting a drug into the body of the animal upon impact. For example, U.S. Pat. No. 4,463,953 includes a pod carried on an arrow shaft which releases a drug within the body of the game animal upon penetration. A similar arrangement is shown in U.S. Pat. No. 4,726,594 in which a cylindrical cartridge containing a drug is dispensed by a detonator which explodes on impact and injects the drug from the cartridge through a needle into the game animal.

BRIEF SUMMARY OF THE INVENTION

The conventional technique of draining blood from an animal's circulatory system is not efficient and results in unnecessary suffering. Therefore, there is a continuing interest in providing a more humane and effective method for harvesting a game animal with a hunting arrow.

A hollow shaft hunting arrow constructed according to the present invention carries a small volume of liquified carbon dioxide which is released by flash expansion to produce tension pneumothorax upon penetration. The thorax of the game animal is pressurized with carbon dioxide gas at sub-zero temperature to cause collapse of the lungs and fibrillation of the heart, so that the animal can be harvested on the spot, thus avoiding escape and uncertain recovery.

In the preferred embodiment, the arrow is tubular and includes a reservoir which is pressurized with approximately 10 cc of liquified carbon dioxide. The contents of the charged reservoir are released by flash expansion upon penetration into the animal's thorax and opening actuation of a valve closure or fracture of a seal. A flow passage connects the reservoir with at least one discharge orifice in or adjacent the arrow point, so that upon release, the liquid carbon dioxide expands in the gaseous state and compresses the lungs and freezes the thorax of the game animal.

The expansion of the liquid carbon dioxide occurs at sub-zero temperatures, which flash-chills the thorax, the lungs and the heart. This immediately induces bilateral pneumothorax and also causes fibrillation of the heart. Because of this sudden heart and lung failure, the game animal will be immobilized almost immediately, and the animal will expire quickly, with minimal suffering.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
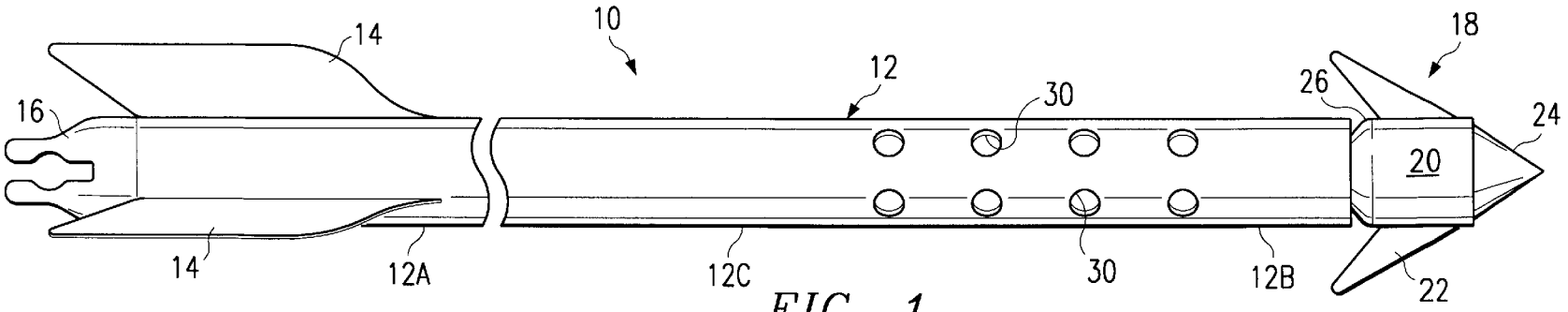
FIG. 1 is side elevational view of a hunting arrow constructed according to the present invention.

Preferred embodiments of the invention will now be described with reference to various examples of how the invention can best be made and used. Like reference numerals are used throughout the description and several views of the drawing to indicate like or corresponding parts.

The most rapid and effective method for rendering a game animal's lungs ineffective is to design the hunting arrow to collapse both lungs, i.e. produce bilateral pneumothorax, and simultaneously arrest the heartbeat. With both lungs collapsed and heart failure, the game animal will be unable to provide adequate exchange of oxygen and carbon dioxide. Therefore, even if the circulatory system were still intact, the game animal would be unable to maintain oxygen levels high enough and/or carbon dioxide low enough to support life at the tissue level.

During respiration, the diameter of the game animal's thorax and rib cage is increased by flexing the intercostal muscles. The length of the intrathoracic cavity is increased by flexing the diaphragm, which causes it to change shape. In the relaxed state, the diaphragm is dome-shaped, and in its flexed state, it is flat. These two mechanism increase the intrathoracic volume of the game animal. This effort allows the atmospheric pressure to force air through the game animal's airway from the lungs, causing the lungs to inflate. When the intercostal muscles and diaphragm relax, the thorax returns to its original shape with much smaller intrathoracic volume, thus forcing the inhaled air out, which allows the oxygen-depleted and carbon dioxide-enriched air to be forced from the animal's lungs into the atmosphere.

The integrity of the game animal's respiratory system is maintained by a partial vacuum within its thorax which allows the lungs to remain inflated. The atmospheric pressure of inhaled air expands the volume of the lungs as the volume of the thorax is increased by the animal's intercostal (between the rib) muscles, as well as the animal's diaphragm.

According to the present invention, a quick kill is achieved by inducing bilateral pneumothorax and fibrillation of the heart by discharging a large volume of carbon dioxide gas at sub-zero temperatures which flash-chills the thorax, the lungs and the heart. When the heart is suddenly chilled, it stops beating and begins fibrillating (twitching) which is more effective than piercing the heart. Moreover, the thoracic cavity is suddenly pressurized, thus compressing and collapsing both lungs, which immediately terminates respiration and the flow of oxygen. When both lungs are compressed and collapsed, this state in the game animal is referred to as "tension pneumothorax." The mechanism of death is still the interruption of the animal's ability to adequately exchange oxygen and carbon dioxide at the tissue level. However, the present invention renders the animal's lungs and heart ineffective rather than draining blood from its circulatory system.

A hunting arrow capable of producing tension pneumothorax and flash chilling the thorax and surrounding organs is described below.

Figure 2:
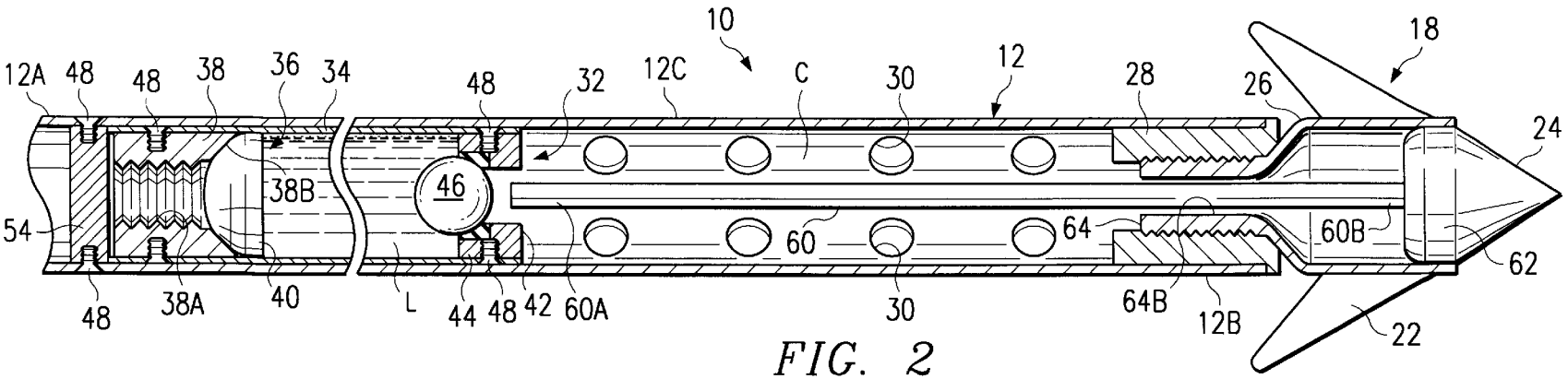
FIG. 2 is a longitudinal sectional view thereof, showing the position of the arrow components prior to penetration.

Referring now to FIG. 1 and FIG. 2, a hunting arrow 10 has a hollow shaft 12 made of tubular material. The length of the arrow shaft may vary, typically extending 25 inches–35 inches from its trailing or aft end 12A to its leading or forward end 12B, and is made from commercially available materials such as fiberglass tubes, hollow plastic shafts and thin-walled aluminum shafts.

Conventional stabilizers 14 are attached to the aft end 12A of the shaft and are secured by an adhesive such as epoxy resin. The stabilizers 14 are preferably made of a plastic material, but other materials such as feathers and paper may be used. A conventional nock 16 is fitted to the aft end of the arrow shaft for receiving the bow string.

The forward end of the arrow 12B is fitted with a compound arrow head 18 which consists of a stationary broad head 20 with fixed splines 22 and a movable chisel point piercing member 24 that is mounted for axial movement within a tubular receiver barrel 26. The receiver barrel 26 is secured to the forward end 12B of the arrow shaft by a threaded end fitting 28.

According to an important feature of the invention, multiple vent holes or discharge apertures 30 are formed in a fenestrated shaft section 12C near the arrowhead. The vent apertures 30 are drilled through a hollow sidewall portion 12C of the shaft 12 at a distance of from about six inches up to twelve to twenty inches from the arrowhead 18, depending on the size of the thorax of the animal being hunted. The number and the size of the discharge apertures 30 are selected to afford rapid and complete discharge of pressurized $CO_2$ into the thorax upon penetration.

In this exemplary embodiment, the diameter of each vent aperture 30 is in the range of 1/16 inch–3/32 inch. The number of vent apertures 30 is selected to provide an effective discharge cross-section area which is at least as large as and preferably larger than the flow discharge outlet area of the release valve. Preferably, eight flow discharge apertures are provided, each having a diameter of 3/32 inch, and are substantially equally spaced on three inch centers in four rows along the length of the arrow shaft sidewall section 12C.

Figure 3:
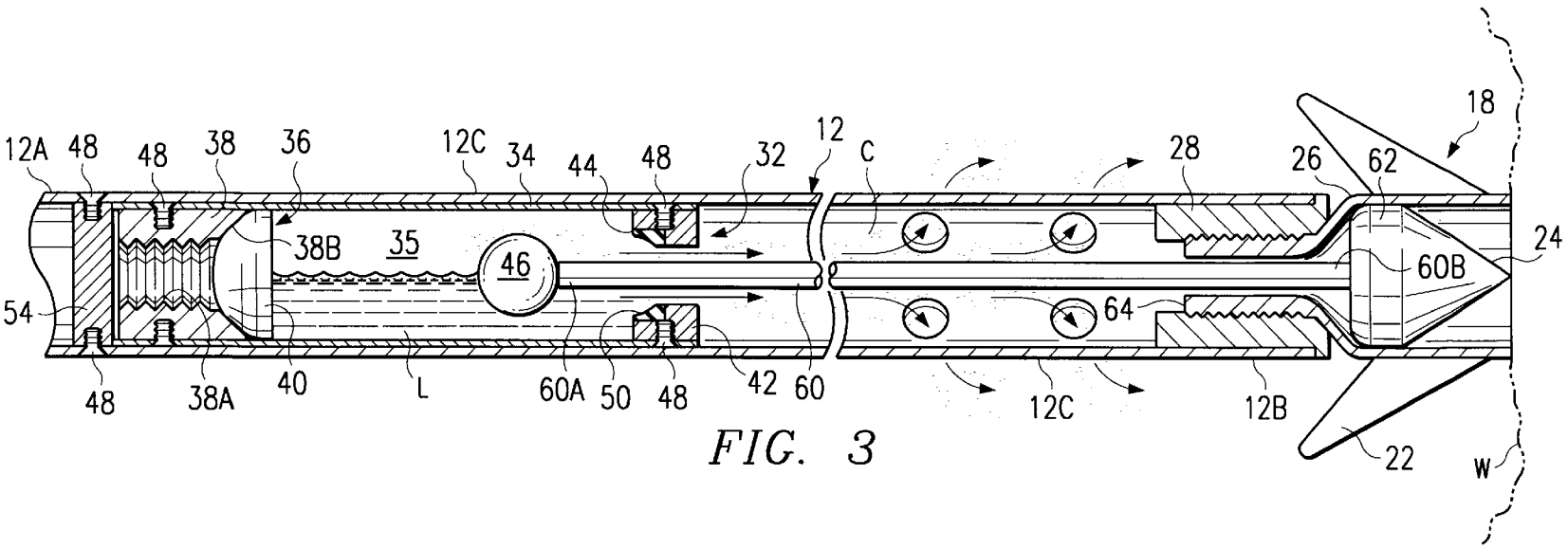
FIG. 3 is a view similar to FIG. 2, partially broken away, showing the release position of the arrow components after penetration.

As shown in FIG. 2 and FIG. 3, the vent holes 30 are located between the arrow point 18 and a release valve 32, thus providing vent ports for discharging $CO_2$ gas from the release valve into the thorax of the game animal. In the preferred embodiment, the fenestrated shaft section 12C containing the multiple discharge vent ports 30 is approximately twelve inches in length, as measured from the arrowhead 18, thus defining a vent chamber C.

The fenestrated sidewall portion 12C of the arrow shaft encloses a tubular cannister 34 which is pressurized with a small volume of a liquified gas L, preferably liquid carbon dioxide. The canister 34 is a thin-walled aluminum container which is sealed on one end by the release valve 32. It is sealed on its opposite end by a refill valve assembly 36 which includes a threaded refill fitting 38 and a movable plug seal 40. The canister 34 encloses a reservoir 35 which contains a predetermined volume of liquified gas L, for example 10 cc of liquified carbon dioxide in this exemplary embodiment.

Figure 4:
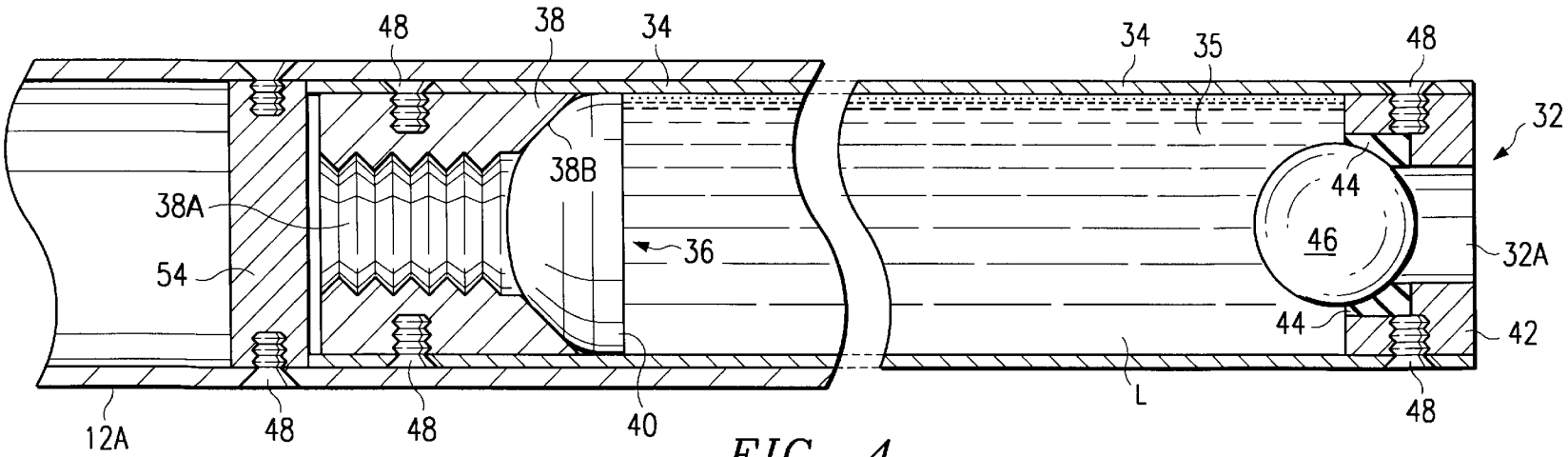
FIG. 4 is an enlarged view of the liquid $CO_2$ container in the fully charged condition.

Referring to FIG. 2, FIG. 3 and FIG. 4, in the preferred embodiment the release valve 32 is a ball valve assembly which includes an annular seal collar 42, an annular valve seat 44 and ball closure member 46. Preferably, the ball closure member 46 is an aluminum ball, and the valve seat 44 is coated with Teflon™ TFE or FEP fluorocarbon polymer. The seal collar 42 is attached by small set screws 48 to the tubular sidewall 12C. The valve closure ball 46 is sized for fluid sealing engagement against the annular valve seat 44 (FIG. 3) which is concentric with the discharge bore of the release valve.

The discharge bore of the release valve 32 provides an outlet flow port 32A through the seal collar 42 and through the valve seat 44. The closure ball 46 seals the outlet flow port in a valve closed position (FIG. 2) and is movable to a valve open position (FIG. 3) in which the outlet flow port 32A is opened and the valve seat is uncovered, thus providing a flow passage from the reservoir 35 into the discharge chamber C in the valve open position.

The canister 34 is charged with five to fifteen cubic centimeters of liquid carbon dioxide and is inserted into the hollow arrow shaft section 12C. The leading end of the canister 34 is engagable with a release actuator 60 which opens the release valve 32 immediately upon penetration, thus releasing the expanding $CO_2$ gas through the outlet flow port 32A into the vent chamber C for discharge into the game animal's thoracic cavity.

The canister 34 is attached to the inside sidewall of the arrow shaft section 12C by small set screws 48. The refill fitting 36 is threaded to engage a fill nozzle through which liquid carbon dioxide is supplied. The liquid carbon dioxide L is produced by compressing and cooling carbon dioxide gas to −37° C. The liquified carbon dioxide is introduced into the canister 34 through the fill port 38A which temporarily displaces the rubber plug 40 as the canister fills. The rubber plug 40 is automatically driven into a sealing position against a valve seat 38B on the recharge fitting 38 as the canister 34 becomes fully pressurized. After the canister 34 has been completely charged with liquified $CO_2$, the plug 40 seats and the refill port 38A is sealed. The canister 34 is locked in place by a stop disc 54, which is secured to the aft end 12A of the arrow shaft by small set screws 48.

Approximately 2 liters of $CO_2$ gas are required to collapse the lungs of a small deer and 4–6 liters for an elk. Each cubic centimeter of liquid $CO_2$ produces approximately one-half liter of gas. The length of the $CO_2$ canister 34 and its diameter are sized appropriately, and in this exemplary embodiment, the canister 34 is sized to hold approximately 10 cc of liquid $CO_2$ (L).

Figure 7:
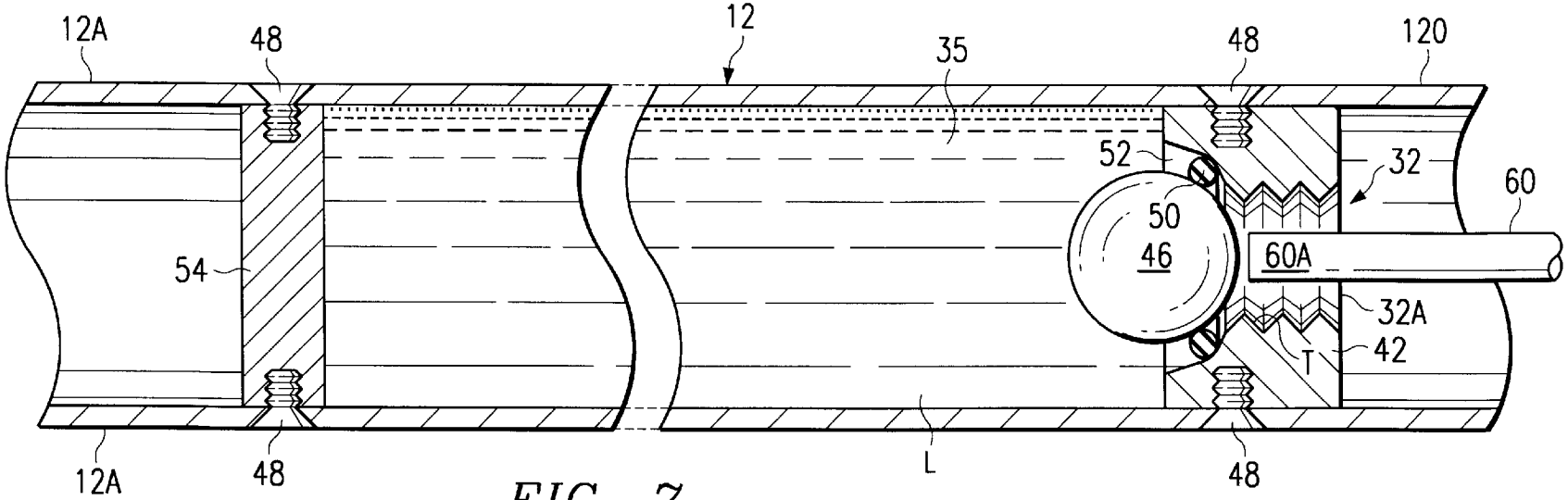
FIG. 7 is an enlarged sectional view, similar to FIG. 4, showing an alternative $CO_2$ reservoir construction.

In an alternative embodiment, shown in FIG. 7, the canister 34 is not utilized, and instead the $CO_2$ reservoir 35 is formed by a length of the tubular sidewall 12, in which the arrow shaft itself holds the liquid $CO_2$. An aluminum plug 54 is first inserted through the bore of the arrow shaft 12, and is anchored in place by set screws 48. The location and spacing distance of the aluminum plug 54 relative to the release valve 32 is determined by the amount or volume of liquid $CO_2$ desired. The valve seat in this embodiment is formed by a resilient O-ring seal 50, which is received within a concave pocket 52 that is machined into the collar 42. The valve closure member 46 in this embodiment is an aluminum ball 46 that is sized for sealing engagement against the O-ring seal 50, shown in the valve closed position in FIG. 7.

In this alternative embodiment, the outlet flow port 32A of the release valve collar 42 is enlarged by a threaded bore T which is sized to mate with the filling nozzle from the liquid $CO_2$ source. The $CO_2$ reservoir 35 is filled and pressurized with liquid carbon dioxide L before the arrowhead 18 is fitted. That is, before the arrowhead 18 and actuator shaft 60 are inserted, the threaded fill port 32A is engaged by the threaded end of a supply tube which is connected to a source of liquid carbon dioxide. After a threaded union is made up, liquid carbon dioxide is pumped into the reservoir 35. As the reservoir is filled, the ball closure member 46 is driven into seated engagement against the O-ring seal 50. The supply tube is then removed after the reservoir 35 is fully charged and sealed. Next, the actuator shaft 60 is inserted through the vent passage C of the arrow until it is received within the throat of the release valve outlet port 32A, as shown in FIG. 7. The barrel 26 of the arrowhead 18 is torqued until the arrowhead is firmly secured in place, with the end 60A of the actuator shaft positioned immediately adjacent the ball closure member 46.

Figure 5:
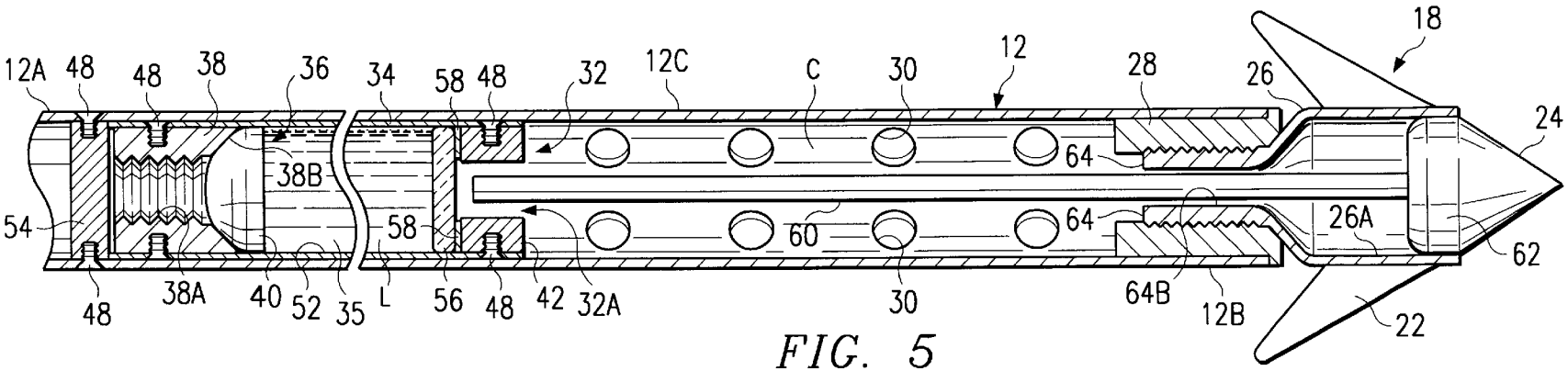
FIG. 5 is a longitudinal sectional view, partially broken away, which illustrates an alternative release valve embodiment.
Figure 6:
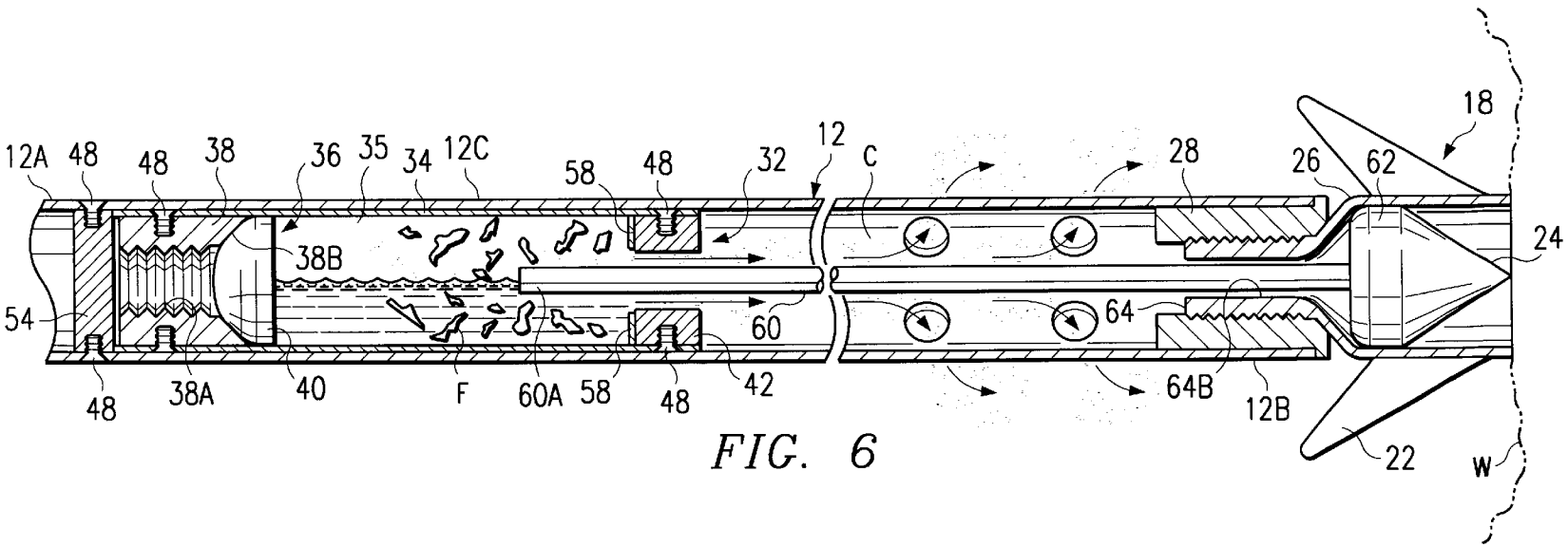
FIG. 6 is a longitudinal sectional view of the arrow shown in FIG. 5, partially broken away, showing the release position of the arrow components after penetration.

Referring now to FIG. 5 and FIG. 6, an alternative release valve embodiment is disclosed. In this arrangement, the valve sealing element is a frangible glass or ceramic lens 56 or metallic membrane which is held in sealing engagement against a seal gasket 58, thus closing the release valve outlet port 32A. The seal gasket, the sealing element and the seal collar 42 are bonded together by adhesive deposits.

Because of the extremely low temperature (about−37° C.) of the liquid carbon dioxide L, the glass, ceramic or metallic material of the sealing element 56 will be relatively brittle, and easy to penetrate or shatter in response to a high intensity impact. A high intensity impact sufficient to move, break or rupture the sealing element 56 is transmitted by an actuator shaft 60 which is attached to the movable arrow point 24. According to this arrangement, the actuator shaft 60 functions generally as a valve actuator, and in particular as a firing pin mechanism.

The actuator shaft 60 is attached on its forward end to a movable arrow core 62. The movable arrow core 62 is dimensioned and formed for a sliding fit within the inside bore 26A of the receiver barrel 26. The tubular shank portion 64 is threaded externally and is coupled in a threaded union T with the end fitting 28 as shown in FIG. 2. The actuator shaft 60 is guided for retracting movement by a narrow diameter, tubular shank portion 64 which is integrally formed with and extends aft of the retainer barrel 26. The actuator shaft 60 is dimensioned for a sliding fit within the inner bore 64B of the tubular shank portion 64.

The aft end portion 60A of the actuator shaft is positioned immediately adjacent the closure member within the throat of the outlet flow port as shown in FIG. 2, FIG. 3, FIG. 5 and FIG. 7, but not touching the valve closure member. According to this arrangement, the actuator end portion 60A is properly positioned for thrust transmitting engagement against the valve closure member in response to retraction movement of the arrow point piercing member 24.

Upon penetration, the chisel point 24 and arrowhead core 62 are retracted, thus driving the actuator shaft end portion 60A into the lens or membrane 56, which shatters the lens into fragments F (FIG. 6) or ruptures the membrane, thus releasing high pressure $CO_2$ into the vent chamber C. Prior to impact, the chisel point 24 extends forward of the arrowhead 18, as shown in FIG. 1, FIG. 2 and FIG. 5. However, upon impact, the chisel point 24 and the arrow core 62 are retracted into the retainer barrel 26, thus driving the actuator shaft 60 into the release valve closure member.

In the embodiment shown in FIG. 2, FIG. 3 and FIG. 7, the release valve closure member is the closure ball 46. As the actuator shaft end portion 60A is driven into the closure ball 46, it unseats the closure ball and permits high pressure $CO_2$ to vent into the vent chamber C. Upon penetration, the aft end 60A of the actuator shaft is retracted into the reservoir 35, as shown in FIG. 3 and FIG. 6. Because of the interference imposed by the actuator shaft, and since the actuator shaft cannot move forward upon penetration, the sealing ball 46 cannot re-engage the valve seat 44, thus permitting all of the pressurized $CO_2$ contents to be delivered into the vent chamber C. Likewise, after the frangible seal 56 is ruptured or shattered, all of the $CO_2$ contents are delivered immediately into the vent chamber C for flash discharge through the apertures 30 into the game animal's thorax.

The compound arrowhead 18 is designed with a freely movable center core 62. When the arrow point 24 makes contact, the center core retracts, providing the energy needed to drive the release valve 32 to the open position. Opening actuation of the release valve 32 is accomplished as the center core 62 of the arrowhead retracts through the retainer guide barrel 26 of the arrowhead. The center core 62 of the arrowhead consists of the arrow point 24 at one end tapering to the actuator shaft end portion 60A at the aft end which engages the release valve closure member. The release valve 32 is actuated open by either piercing a metallic membrane, fracturing a glass or ceramic lens 56 or moving and unseating the closure ball 46 of the ball valve assembly.

The design of the arrowhead 18 with a retractable core 62 not only provides the mechanism for releasing the liquified carbon dioxide, but also allows the arrowhead 18 to change its configuration after penetrating the wall W of the thoracic cavity. After the arrow point 24 has retracted inside the receiver barrel 26 of the arrowhead, the end of the arrow is reconfigured into a blunt end. The blunt end will arrest the arrow as it engages the opposite wall W of the thorax, thus opposing pass-through, and ensuring proper placement of the fenestrated arrow section 12C within the thoracic cavity as the low temperature $CO_2$ gas is completely discharged.

The release of the low temperature $CO_2$ gas into the thorax of the animal will produce two effects. The first effect will be to produce a bilateral pneumothorax—the collapse of both lungs. Secondly, because the $CO_2$ is being converted from a liquid state into a gas, the gas being introduced into the game animal's thorax will be at a very low temperature, 83° F. below zero (−37° C.). This chilling effect produces an interruption of the electrical activity of the heart. An occurrence known as fibrillation takes place in the heart at temperatures below +35° F. During fibrillation, the heart muscles cease to contract in a coordinated effort and instead merely twitch. During this time the heart is not pumping blood and the game animal's blood pressure drops to zero.

Collapsing both lungs will prevent the game animal from exchanging oxygen and $CO_2$ with the environment. Death occurs when either the oxygen tension is not high enough or the $CO_2$ tension is too high to support normal tissue function. The presence of pressurized $CO_2$ inside the thorax will also enhance the increase in $CO_2$ tension in the animal's blood, thus accelerating the death process. The increase of $CO_2$ tension in the game animal kills primarily by the production of carbonic acid forcing the pH of the blood down. A low pH in the game animal also makes its heart susceptible to fibrillation.

A small amount of fluorescent dye may be introduced in the liquified $CO_2$ which will provide a marker in the blood trail left by the wounded animal. At night the blood trace will then fluoresce or glow when exposed to ultraviolet light from a small portable UV lantern.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. A hunting arrow comprising, in combination:

a shaft including a leading end, a trailing end and a tubular sidewall portion disposed between the leading end and the trailing end;

the tubular sidewall portion containing a reservoir for storing a volume of liquified gas;

a release valve coupled in fluid communication with the reservoir, the release valve including an outlet flow port and a movable closure member which closes the outlet flow port in a valve closed position and opens the outlet flow port in a valve open position;

an arrowhead attached to the leading end of the shaft, the arrowhead including a fixed head portion and a piercing member movably coupled to the fixed head portion for retraction relative thereto; and, an actuator coupled to the movable piercing member for engaging the valve closure member and unsealing the outlet flow port in response to retraction movement of the piercing member relative to the fixed head portion.

2. A hunting arrow as set forth in claim 1, wherein the release valve is a ball valve assembly which includes an annular valve seat disposed in communication with the outlet flow port and a ball closure member engagable with the valve seat in the valve closed position, and movable to an unseated position inside of the reservoir in the valve open position.

3. A hunting arrow as set forth in claim 1, wherein the valve closure member comprises a frangible lens constructed of glass.

4. A hunting arrow as set forth in claim 1, wherein the valve closure member comprises a membrane constructed of a metallic material.

5. A hunting arrow as set forth in claim 1, including a volume of liquified gas disposed in the reservoir.

6. A hunting arrow as set forth in claim 5, wherein the volume of liquified gas is in the range of 5 cc–10 cc.

7. A hunting arrow as set forth in claim 5, wherein the liquified gas comprises liquified carbon dioxide.

8. A hunting arrow as set forth in claim 1, including a volume of liquid fluorescent dye disposed in the reservoir.

9. A hunting arrow as set forth in claim 1, wherein the shaft includes a tubular sidewall section defining a vent chamber between the leading end and the trailing end, and the actuator comprises an elongated shaft extending through the vent chamber from the arrowhead to the release valve assembly, the actuator shaft including a first end portion attached to the piercing member and a second end portion disposed for thrust transmitting engagement against the valve closure member.

10. A hunting arrow as set forth in claim 1, wherein the shaft includes a tubular sidewall section disposed between the leading end and the trailing end thereby defining a vent chamber, the tubular sidewall section being intersected by a plurality of vent ports for discharging expanding gas from the vent chamber.

11. A hunting arrow as set forth in claim 1, wherein the container includes a refill valve assembly, the refill valve assembly including an inlet flow port, an annular valve seat disposed in communication with the inlet flow port and a movable plug disposed in the reservoir for sealing engagement against the refill valve seat.

12. A hunting arrow as set forth in claim 1, the fixed head portion of the arrowhead including a tubular receiver barrel, and the arrowhead also including an arrow core disposed for axial retraction movement through the receiver barrel, the arrow core being disposed between the piercing member and the actuator.

13. A hunting arrow as set forth in claim 1, wherein the fixed head portion of the arrowhead includes a tubular receiver, and the piercing member is disposed for retraction movement through the tubular receiver, and the actuator includes an elongated shaft having a first end portion attached to the piercing member and a second end portion disposed for axial retraction movement through the release valve outlet flow port.

14. A hunting arrow as set forth in claim 1, including a cylindrical canister enclosed within the tubular sidewall section, and the reservoir is enclosed within the canister.

15. A hunting arrow as set forth in claim 14, the liquified gas container including a refill inlet flow port, a refill valve assembly coupled to the refill inlet flow port and a refill fitting disposed within the tubular sidewall section, the refill fitting including a threaded bore disposed in communication with the refill inlet flow port.

16. A hunting arrow as set forth in claim 14, including a stop disc disposed in the tubular sidewall section adjacent the canister and locked against the arrow shaft.

17. A hunting arrow as set forth in claim 1 including a first seal member disposed in the bore of the tubular sidewall portion defining a first axial boundary of the reservoir, and the release valve defining a second axial boundary of the reservoir, and the tubular sidewall portion extending between the first seal member and the release valve defining a radial boundary of the reservoir.

18. A hunting arrow as set forth in claim 1, the fixed head portion of the arrowhead including an annular end fitting attached to the leading end of the shaft, the end fitting being intersected by an axially extending threaded bore, and the fixed head portion of the arrowhead further including a tubular receiver, and the tubular receiver having a threaded shank portion disposed in a threaded union with the end fitting.

19. A hunting arrow as set forth in claim 1, including a refill fitting coupled to the release valve, the refill fitting comprising threaded bore disposed in communication with the outlet flow port.

20. A hunting arrow as set forth in claim 1, wherein the release valve is a ball valve assembly which includes an annular valve body, a resilient O-ring seal member mounted on the valve body adjacent the outlet flow port and a ball closure member seated in engagement with the O-ring seal in the valve closed position, and movable to an unseated position inside of the reservoir in the valve open position.

21. A method for harvesting a game animal with a hunting arrow comprising the steps:

charging the hunting arrow with a volume of liquified gas;

penetrating the game animal with the arrow;

releasing the liquified gas by flash expansion into the game animal's thorax at sub-zero temperature to cause collapse of the game animal's lungs and fibrillation of its heart.

* * * * *